US005966947A

United States Patent [19]

Kamimura et al.

[11] Patent Number: 5,966,947

[45] Date of Patent: Oct. 19, 1999

[54] METHOD OF RETURNING REFRIGERATOR OIL OF AIR CONDITIONER

[75] Inventors: Ichiro Kamimura, Nitta-gun; Norio Sawada, Ora-gun; Tetsuya Masuda, Ora-gun; Koji Sato, Ora-gun, all of Japan

[73] Assignee: Sanyo Electric Co., Ltd., Osaka, Japan

[21] Appl. No.: 08/976,087

[22] Filed: Nov. 21, 1997

[30] Foreign Application Priority Data

Dec. 12, 1996 [JP] Japan ..... 8-332436

[51] Int. Cl.[6] ..... F25B 43/02

[52] U.S. Cl. ..... 62/84; 62/192; 62/468

[58] Field of Search ..... 62/192, 84, 470, 62/468, 193

[56] References Cited

U.S. PATENT DOCUMENTS 5,361,595 11/1994 Shimura et al. ..... 62/192

*Primary Examiner*—John M. Sollecito

*Attorney, Agent, or Firm*—Wenderoth, Lind & Ponack, L.L.P.

[57] ABSTRACT

An air conditioner has an outdoor unit and a plurality of room units supplied with a refrigerant from the outdoor unit. The outdoor unit and the room units are connected by a plurality of refrigerant pipes. In a recovery operation for returning refrigerator oil from the room units, the refrigerant pipes and the like to the outdoor unit, the plurality of room units are divided into a plurality of room unit groups, and the recovery operation of the refrigerant is carried out for each of the room unit groups.

4 Claims, 4 Drawing Sheets

METHOD OF RETURNING REFRIGERATOR OIL OF AIR CONDITIONER

BACKGROUND OF THE INVENTION

1. Field of the Invention

The present invention relates to a method of returning a refrigerator oil of an air conditioner by which in operating a refrigerating cycle constituted to circulate a mixture of an HFC refrigerant and refrigerator oil by a compressor, when the refrigerator oil discharged from the compressor along with the refrigerant is adhered to inner walls or the like of refrigerant pipes, a heat side heat exchanger, user side heat exchangers and the like in the refrigerating cycle and the refrigerator oil present in the compressor is reduced, a recovery operation carried out for returning the refrigerator oil can be performed in a short period of time and reliably.

2. Description of Related Art

Generally, in an air conditioner, an outdoor unit mounted with a compressor, an accumulator, heat side heat exchangers and the like and room units mounted with user side heat exchangers, expansion valves and the like, are connected by refrigerant pipes to establish a refrigerating cycle, and a mixture of a refrigerant and a refrigerator oil is circulated in the refrigerating cycle.

The mixture is made to flow from the outdoor unit to the room units, subjected to heat exchange (condensing operation or evaporating operation) at the user side heat exchangers, returned to the accumulator, and thereafter drawn again to the compressor. However, depending on the difference of elevation between the outdoor unit and the room units, a prolonged pipeline and the solubility of the refrigerant in respect of the refrigerator oil, some of the refrigerator oil may not be returned to the accumulator, but adheres to or remains at the inner walls of the refrigerant pipes, the inside of the user side heat exchangers and the like.

Hence, there are many air conditioners having an outdoor unit installed on the roof, to evaluate return of the refrigerator oil at predetermined intervals in order to avoid the amount of the refrigerator oil in the compressor from decreasing to less than a necessary amount.

The operation of returning the refrigerator oil is carried out by, for example, fully opening expansion valves of the room units operating as pressure reducing devices (or the opening degree is enlarged more than that in normal heating and cooling operation in accordance with the capacity of the room units) and by operating the compressor at maximum capacity.

That is, the amount of supply of the mixture of the refrigerant and the refrigerator oil to the room units is increased by operating the compressor at high power by which the flow rate of the mixture is accelerated in the refrigerant pipes and the refrigerator oil is returned by blowing off the refrigerator oil adhered to the inner walls of the refrigerant pipes and the like.

Meanwhile, the solubility of the refrigerant in respect of the refrigerator oil differs depending on the kind of the refrigerant, and when the solubility of the refrigerant is low (when the compatibility is poor), the viscosity of the refrigerator oil is increased as a result. For example, in the case of an HFC refrigerant, the solubility of the refrigerant in respect of the refrigerator oil is lower than the solubilities of CFC and HCFC refrigerants in respect of the refrigerator oil, and when the same refrigerator oil is used the viscosity of the refrigerator oil in refrigerant pipes is increased more than those of the CFC and HCFC refrigerants. Therefore, a larger flow rate of the refrigerant is required to return the refrigerator oil adhered to the refrigerant pipes.

Meanwhile, in the case of a so-called multi-unit type air conditioner where a plurality of room units are connected to one outdoor unit, the refrigerant pipes are long and complicated. Further, the amount of the refrigerator oil is determined based on the maximum capacity of a compressor, and accordingly the refrigerator oil is generally decreased in comparison with the amount of the refrigerant, and it becomes important to return effectively the refrigerator oil by a recovery operation.

Normally, in the case of such a multi-unit type air conditioner as described above, a total of the capacities of the plurality of room units is actually set to be larger than the capacity of the compressor of the outdoor unit. This is mainly due to the following reason.

The load of air conditioning in rooms is varied during one day and for example, considering the refrigerating operation, in the morning the load of an east side room is increased by direct sunlight, and in the afternoon, the load of a west side room is increased. Accordingly, by selecting the capacity of the outdoor unit in accordance with a total of loads in all the rooms, the investment cost and a space for installing the outdoor unit can be reduced.

Therefore, in the recovery operation for returning the refrigerator oil adhered to the refrigerant pipes for connecting the outdoor unit and the room units or devices in the room units to the outdoor unit (compressor), even when, for example, expansion valves of all the room units are fully opened and the compressor is driven by the maximum capacity, if an HFC refrigerant is used, an amount of circulating the refrigerant necessary for rated capacities of the respective room units cannot be provided. That is, the necessary flow rate of the refrigerant cannot be provided, and therefore complete recovery (returning) of the refrigerator oil cannot be achieved.

SUMMARY OF THE INVENTION

The present invention has been carried out in view of the above-described situation and it is a principal object of the present invention to provide a new method of returning a refrigerator oil of an air conditioner.

Another object of the present invention is to provide a new method of returning a refrigerator oil of an air conditioner which permits the return in a short period of time and reliably of a refrigerator oil adhered to inner walls of refrigerant pipes and the like.

Hence, according to an aspect of the present invention, there is provided a method of returning a refrigerant of an air conditioner having an outdoor unit and a plurality of room units supplied with a refrigerant from the outdoor unit, in which the outdoor unit and the room units are connected by a plurality of refrigerant pipes, wherein, in a recovery operation for returning the refrigerator oil from the room units, the plurality of room units are divided into a plurality of room unit groups, and a recovery operation of the refrigerant is carried out for each of the room unit groups.

Further, according to a second aspect of the present invention, the flow rate of a mixture of the refrigerant and the refrigerator oil in the recovery operation of the refrigerant flowing in room unit heat exchangers (namely, user side heat exchangers) is maintained at a predetermined value or more.

Further, according to a third aspect of the present invention, the refrigerant used in the refrigerating cycle is an HFC refrigerant.

Further, according to a fourth aspect of the present invention, a number of the user side units included in the respective groups is a number of units by which the flow rate of the mixture can be maintained at a predetermined value or more in the operation of returning the refrigerator oil.

DETAILED DESCRIPTION OF THE PREFERRED EMBODIMENTS

An explanation will be given of an embodiment of the present invention in reference to drawings as follows.

Figure 1:
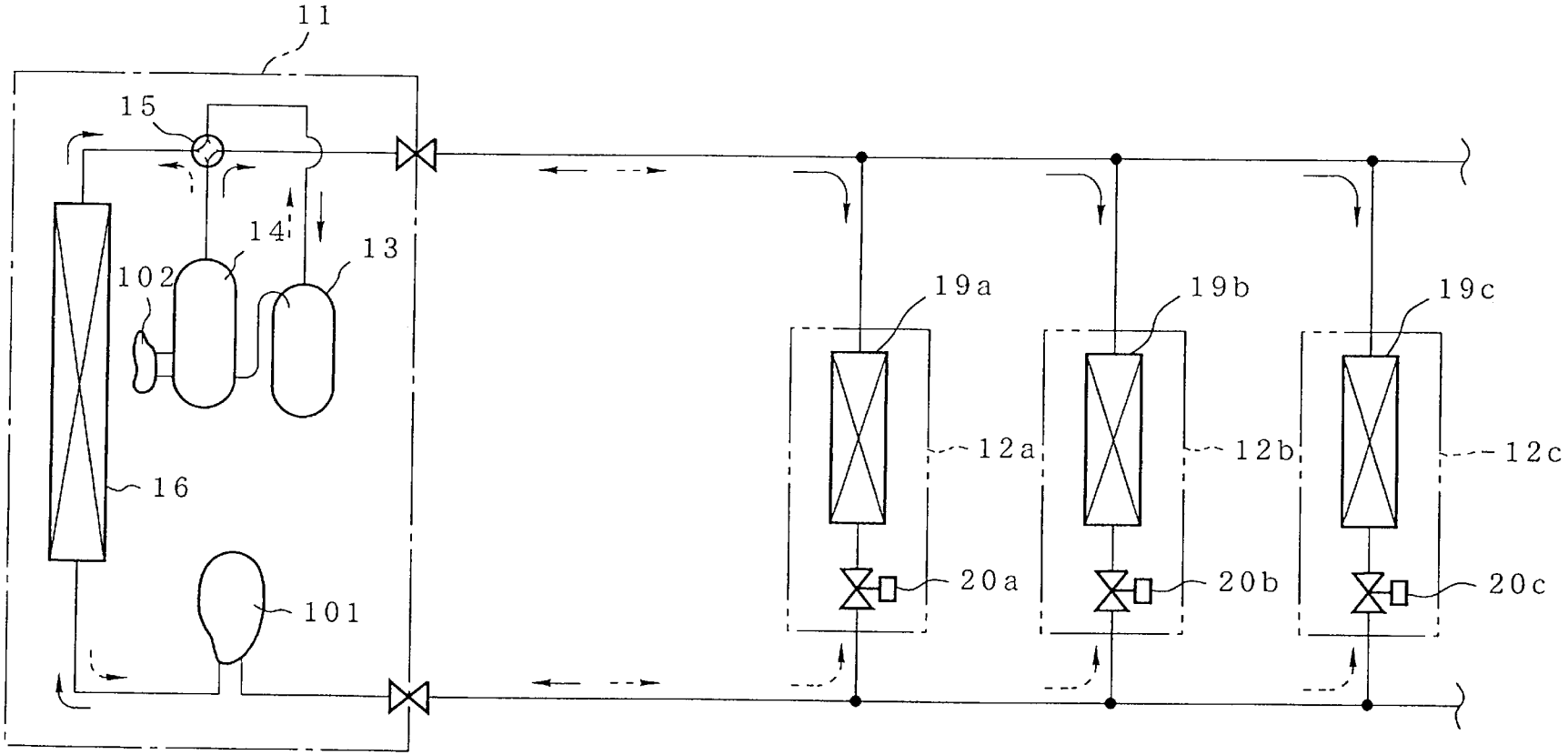
FIG. 1 is a diagram of a refrigerating cycle of an air conditioner according to an embodiment of the present invention.

In FIG. 1 showing a refrigerating cycle of an air conditioner according to the present invention, the air conditioner is a multi-unit type air conditioner in which a plurality of room units 12*a* through 12*c* are connected to one outdoor unit 11.

The outdoor unit 11 includes an accumulator 13, a compressor 14, a four way valve 15, a heat source side heat exchanger 16, a receiver tank 101 and the like, and the respective room units 12*a*–12*c* include user side heat exchangers 19*a*–19*c* and electrically driven expansion valves 20*a*–20*c* and the like.

The respective devices of the outdoor unit 11 and the room units 12*a*–12*c* are connected such that a mixture of a refrigerant (HFC refrigerant or HC refrigerant of R410A, R410B, R407C or the like) and a refrigerator oil (ether group, ester group or the like) is circulated via refrigerant pipes by which a refrigerating cycle is formed.

According to the air conditioner shown by FIG. 1, in a refrigerating operation, a gas refrigerant at high temperature and high pressure discharged from the compressor 14 of the outdoor unit 11, is made to flow in the heat source side heat exchanger 16 via the four way valve 15 as shown by broken line arrows. The gas refrigerant is condensed into a liquid refrigerant in the heat source side heat exchanger 16 and stored once in the receiver tank 101. Thereafter, the liquid refrigerant reaches the respective room units 12*a*–12*c* via refrigerant pipes and is supplied to the user side heat exchangers 19*a*–19*c* after the flow rates are controlled by the electrically driven expansion valves 20*a*–20*c*.

The liquid refrigerant is evaporated at the user side heat exchangers 19*a*–19*c*, subjected to cooling of air-conditioned rooms, and thereafter recirculated to the compressor 14 via the refrigerant pipes, the four way valve 15 and the accumulator 13.

On the other hand, in a heating operation, the refrigerant is circulated in a direction reverse to the direction in the cooling operation as shown by bold line arrows. That is, a cycle is formed in which the gas refrigerant at high temperature and high pressure discharged from the compressor 14 is fed to the receiver tank via the four way valve 15, the user side heat exchangers 19*a*–19*c* and the electrically driven expansion valves 20*a*–20*c* at the room units and reaches again the compressor 14 via the heat source side heat exchanger 16 and the accumulator 13.

Further, a liquid level sensor 102 (for example, a float moving up and down along with a liquid level) for detecting the liquid level of the refrigerator oil in the compressor is installed to the compressor 14.

Although three of the room units 12*a* through 12*c* are shown in FIG. 1, the number of the room units is not limited thereto but can be selected as desired.

Figure 2:
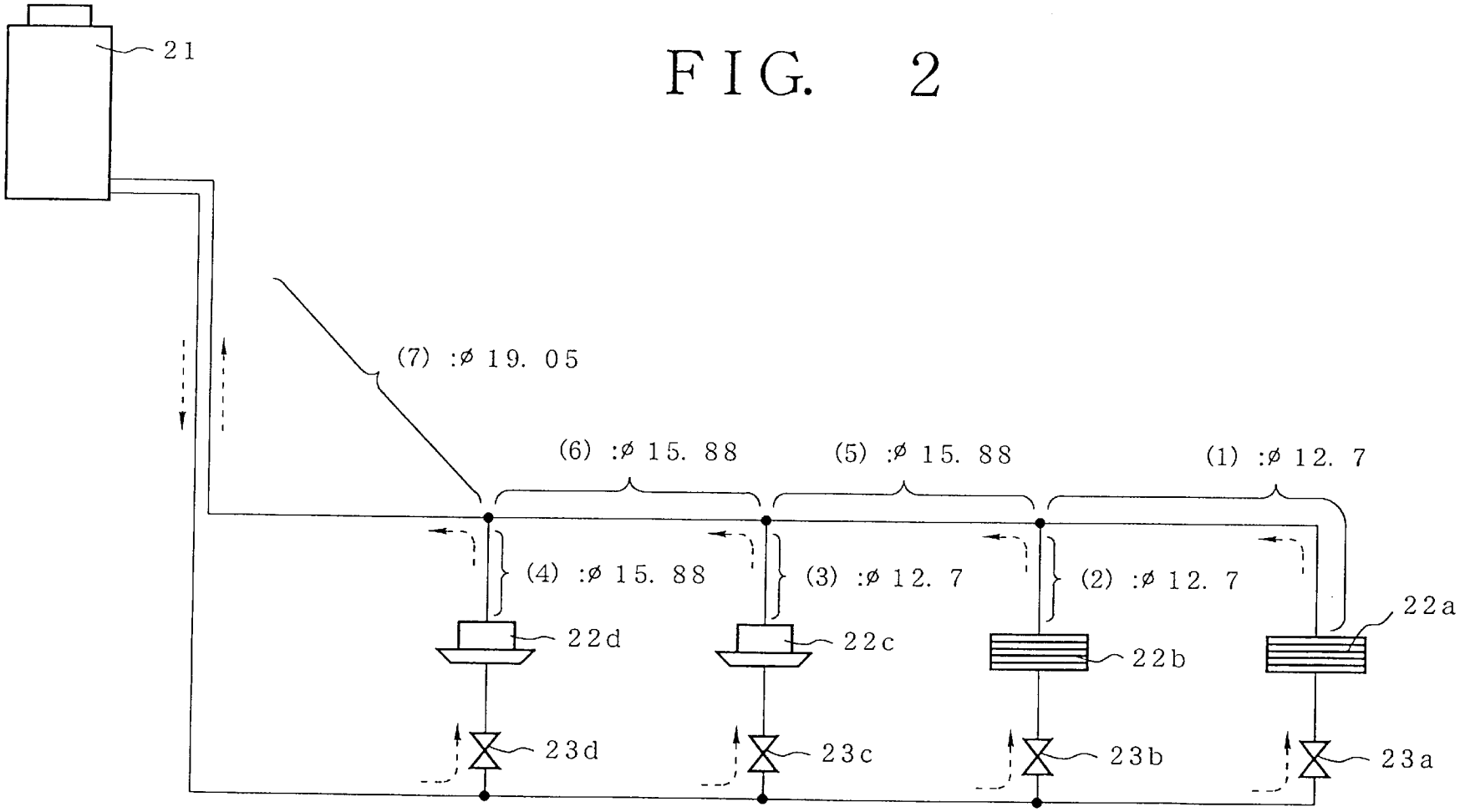
FIG. 2 is a model diagram of an example of a multi-unit type air conditioner to which the present invention is applied.

A model of a multi-unit type air conditioner shown in FIG. 2 now will be considered. According to such air conditioner, an HFC refrigerant is used and four room units 22*a*–22*d* are connected to an outdoor unit 21 having a capacity of 5 horsepower (refrigerating capacity: about 14 kW) by using refrigerant piping to constitute a refrigerating cycle.

Electrically driven expansion valves 23*a*–23*d* for controlling the flow rate of the refrigerant are installed to the room units 22*a*–22*d*, respectively. The maximum output of each of the room units 22*a*–22*c* is set to 1 horsepower (refrigerating capacity: about 2.8 kW) and the maximum output of the fourth room unit 22*d* is set to 3 horsepower (refrigerating capacity: about 8 kW).

In FIG. 2, the flowing direction of the refrigerant in the cooling operation and in the recovery operation of the refrigerator oil is shown by broken line arrows, and the outer diameters of intake pipes thereof are set as follows in consideration of the amount of the refrigerant necessary for flowing to the intake pipes (that is, maximum capacity of the room units). The outer diameters of refrigerant pipes (pipe number: (1) through (3)) directly connected to the first through the third room units 22*a*–22*c*, respectively, of 1 horsepower are set to ϕ 12.7 mm, the outer diameter of the refrigerant pipe (pipe number (4)) directly connected to the fourth room unit 22*d* is set to ϕ 15.88 mm, the outer diameter of the refrigerant pipe (pipe number (5)) between the second and the third room units 22*b* and 22*c* is set to ϕ 15.88 mm, the outer diameter of the refrigerant pipe (pipe number (6)) between the third and the fourth room units 22*c* and 22*d* is set to ϕ 15.88 mm and finally, the outer diameter of the refrigerant pipe (pipe number (7)) connected to the outdoor unit 21 is set to ϕ 19.05 mm.

According to such multi-unit type air conditioner, a total of the maximum outputs of the first through the fourth room units 22*a*–22*d* is 6 horsepower which exceeds the capacity of the outdoor unit 21 of 5 horsepower. Accordingly, in the recovery operation of the refrigerator oil, even when the compressor 14 is operated at the maximum capacity, the refrigerant having an amount in compliance with the maximum operational capacity, that is the refrigerant necessary for achieving the maximum capacity, is not supplied to the respective room units 22*a*–22*d* and the refrigerant is distributed in proportion to the rated capacities (outer diameters of refrigerant pipes) of the respective room units 22*a*–22*d*.

As a result, as shown by Table 1, the refrigerant is made to flow in correspondence with 5/6 (=0.83) horsepower for the first through the third room units 22*a*–22*c* and 5/2 (=2.5) horsepower for the fourth room unit 22d. In this case, the refrigerant is made to flow at flow rates shown by Table 1 in the respective refrigerant pipes (pipe number; (1) through (7)), sufficient results are obtained only with respect to the refrigerant pipes of the pipe numbers (4), (6) and (7) designated by marks in Table 1 in the recovery of the refrigerator oil and the recovery of the refrigerator oil becomes insufficient in the other pipes. According to an experiment, a flow rate necessary for returning the refrigerator oil in the case of an HFC refrigerant is considered to be 10 m/s or more in respect of this embodiment and only the refrigerant pipes having the pipe numbers (4), (6) and (7) satisfy the condition of such flow rate.

TABLE 1

| Pipe No. | Capacity Distribution (horse power) | Refrigerant Flow Rate (m/s) | Return of Oil |
|---|---|---|---|
| (1) | 5/6 | 6.7 | x |
| (2) | 5/6 | 6.7 | x |
| (3) | 5/6 | 6.7 | x |
| (4) | 5/2 | 12.9 | ○ |
| (5) | (5/3) | 8.6 | x |
| (6) | (5/2) | 12.9 | ○ |
| (7) | (5) | 17.1 | ○ |

Figure 3:
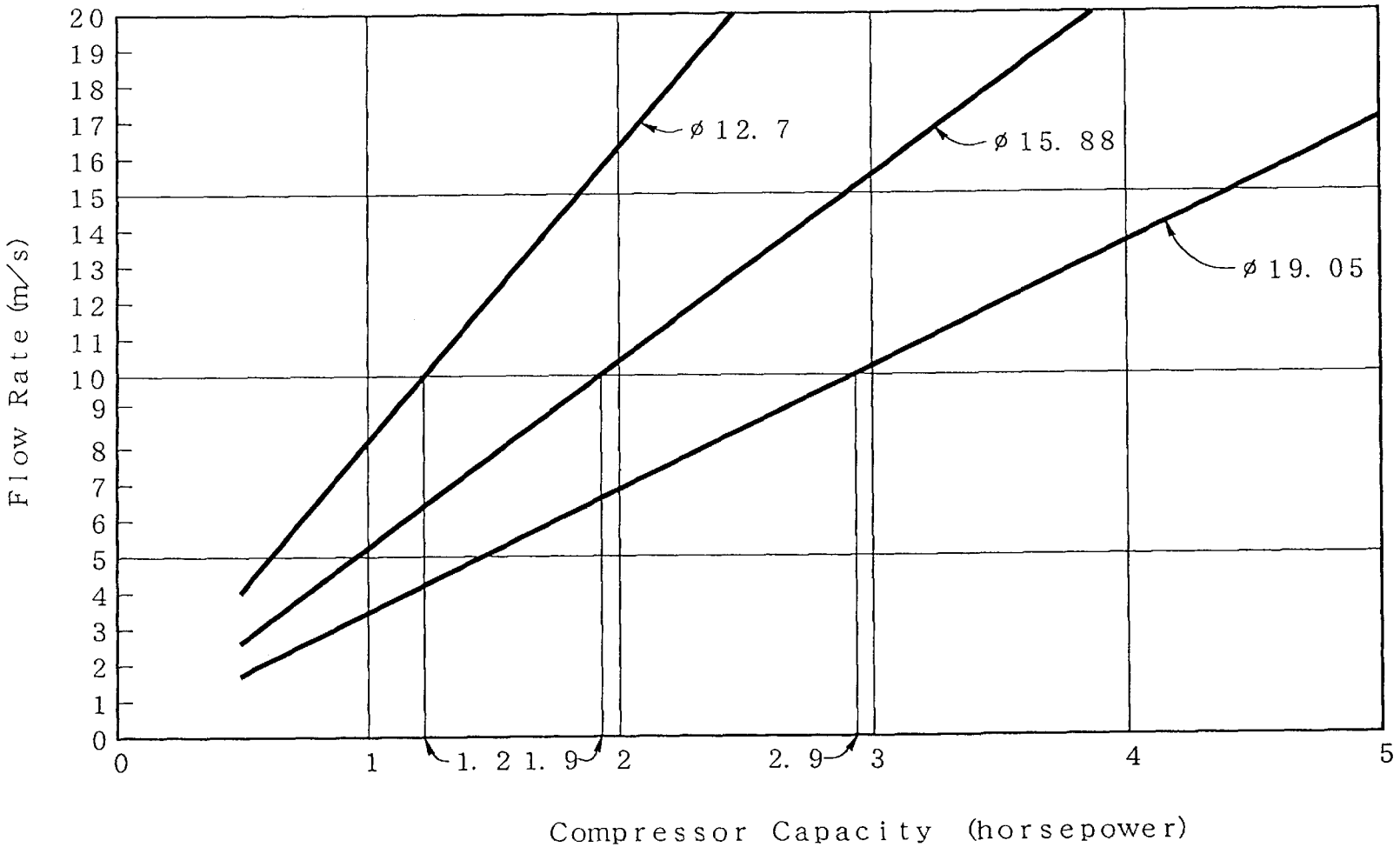
FIG. 3 is a graph representing changes in flow rates of a refrigerant when a capacity of a compressor is changed in respect of diameters of pipes.

FIG. 3 shows a relationship between a capacity of a compressor and a flow rate of a refrigerant for respective refrigerant pipe diameters. As shown by FIG. 3, the capacity of the compressor for providing the flow rate of the refrigerant of 10 m/s necessary for returning the refrigerator oil, is 1.2 horsepower when the refrigerant pipe diameter is 12.7 mm, 1.9 horsepower when the refrigerant pipe diameter is 15.88 mm and 2.9 horsepower when the refrigerant pipe diameter is 19.05 mm.

Table 2 shows a relationship among the capacity (horsepower) of the room unit, the diameter of the refrigerant pipe and the flow rate of the refrigerant at the rated capacity. As shown by Table 2, the diameter of the refrigerant pipe is set in a stepwise manner and therefore, the diameters are commonly used for some of the room units having different capacities.

TABLE 2

| Pipe Diameter (mm) | Capacity of Room Unit (horsepower) | Flow Rate of Refrigerant (m/s) | Capacity of Compressor for 10 m/s |
|---|---|---|---|
| 12.7 | 1.0 | 8.1 | 1.2 |
| | 1.3 | 10.1 | |
| 15.88 | 1.6 | 8.2 | 1.9 |
| | 2.0 | 10.3 | |
| | 2.5 | 12.9 | |
| | 3.0 | 15.5 | |
| 19.05 | 3.2 | 10.9 | 2.9 |
| | 4.0 | 13.7 | |
| | 5.0 | 17.1 | |
| | 6.0 | 20.5 | |

Therefore, even when the capacity of the room units and the capacity of the outdoor unit are the same, there will be cases that the flow rate (10 m/s) of the refrigerant necessary for returning the refrigerator oil not obtained. Furthermore, as described above, according to the model, a ratio of capacities of room to outdoor units is 1.2 (6 horsepower for the room units and 5 horsepower for the outdoor unit) and therefore the capacity of the compressor is deficient. Hence, according to this embodiment, as shown by Table 3, the recovery operation of the refrigerator oil is performed by dividing the operation into operation patterns 1 and 2 to provide the flow rate of the refrigerant of 10 m/s or more for all the refrigerant pipes.

TABLE 3

| | Operation Pattern 1 | | | Operation Pattern 2 | | |
|---|---|---|---|---|---|---|
| Pipe No. | Cap.Distr. (horsepower) | Refr.Flow Rate (m/s) | Oil Ret. | Cap.Distr. (horsepower) | Refr.Flow Rate (m/s) | Oil Ret. |
| (1) | 1.2 | 10 | ○ | 0.7 | 5.5 | — |
| (2) | 1.2 | 10 | ○ | 0.7 | 5.5 | — |
| (3) | 1.2 | 10 | ○ | 0.7 | 5.5 | — |

TABLE 3-continued

| | Operation Pattern 1 | | | Operation Pattern 2 | | |
|---|---|---|---|---|---|---|
| Pipe No. | Cap.Distr. (horsepower) | Refr.Flow Rate (m/s) | Oil Ret. | Cap.Distr. (horsepower) | Refr.Flow Rate (m/s) | Oil Ret. |
| (4) | 1.4 | 7.5 | x | 2.9 | 10 | ○ |
| (5) | (2.4) | 12.6 | ○ | (1.4) | 7.3 | — |
| (6) | (3.6) | 18.5 | ○ | (2.1) | 10.6 | ○ |
| (7) | (5) | 17.2 | ○ | (5) | 17.2 | ○ |

The abbreviations in Table 3 represent the following:

Cap.distr.: Capacity distribution

Refr.Flow Rate: Refrigerant Flow Rate

Oil Ret.: Oil Return

As shown by Table 3, according to the operation pattern 1, the capacity of the compressor 21 is distributed such that the first through the fourth room units 22*a*–22*c* are operated at 1.2 horsepower and the fourth room unit 22*d* is operated at 1.4 horsepower. The capacity distribution is performed by controlling valve opening degrees of the electrically driven expansion valves 23*a*–23*d*. In this case, the capacity corresponding to 1.2 horsepower is distributed to the refrigerant pipes of pipe numbers (1) through (3), the capacity corresponding to 1.4 horsepower is distributed to the refrigerant pipe of pipe number (4), the capacity corresponding to 2.4 horsepower is distributed to the refrigerant pipe of pipe number (5), the capacity corresponding to 3.6 horsepower is distributed to the refrigerant pipe of pipe number (6) and the capacity corresponding to 5 horsepower is distributed to the refrigerant pipe of pipe number (7).

As a result, the flow rate of the refrigerant of 10 m/s or more is obtained for the refrigerant pipes of pipe numbers (1) through (3) and (5) through (7) and the refrigerator oil is firmly returned. In this embodiment, the maximum capacity of the compressor 14 subtracted by the capacity of the compressor necessary for returning the refrigerator oil for the refrigerant pipes of pipe numbers (1) through (4) is distributed to the room unit 22*d*.

Although the distribution is necessary when the room unit 22*d* is brought into "thermo ON" (operated since deviation between room temperature and set temperature is a predetermined value or more), the distribution is not necessary when the room unit 22*d* is brought into "thermo OFF" (stopped since deviation between room temperature and set temperature is less than a predetermined value) and further the flow rate of the refrigerant at the refrigerant pipe of pipe number (7) reaches a value required for returning the refrigerator oil.

According to the embodiment, even when the room unit 22*d* is brought into thermo OFF and the compressor is operated at 3.6 horsepower, a sufficient flow rate of the refrigerant can be provided at the refrigerant pipe of pipe number (7).

If necessary, the electrically driven expansion valve 23*d* may be fully closed regardless of the operating condition of the room unit 22*d*, the operation capacity of the compressor may be maximized (5 horsepower in this embodiment), the capacity of about 1.7 horsepower may be distributed to the first through the third room units 22*a*–22*c*, and the flow rate of the refrigerant may be increased so that the recovery (returning) may be performed in a shorter period of time.

Next, according to the operation pattern 2, the capacity distribution of the compressor 21 is performed such that the first through the third room units 22*a*–22*c* are operated at 0.7 horsepower and the fourth room unit 22*d* is operated at 2.9 horsepower. In this case, the capacity corresponding to 0.7 horsepower is distributed to the refrigerant pipes of pipe number (1) through (3), the capacity corresponding to 2.9 horsepower is distributed to the refrigerant pipe of pipe number (4), the capacity corresponding to 1.4 horsepower is distributed to the refrigerant pipe of pipe number (5), the capacity corresponding to 2.1 horsepower is distributed to the refrigerant pipe of pipe number (6), and the capacity corresponding to 5 horsepower is distributed to the refrigerant pipe of pipe number (7). As a result, the flow rate of the refrigerant of 10 m/s or more is obtained for the refrigerant pipes of pipe numbers (4), (6) and (7) and the refrigerator oil is returned firmly.

By performing both of the operation patterns 1 and 2, the flow rate of the refrigerant of 10 m/s or more is provided for all the refrigerant pipes and the refrigerator oil can be firmly returned.

When, for example, the flow rate of the refrigerant flowing in the refrigerant pipes of pipe numbers (1) through (4) is 10 m/s or more, the flow rates of the refrigerant flowing in the room units connected to the refrigerant pipes of respective pipe numbers become 10 m/s or more and the refrigerator oil in the room units is returned.

The recovery operation of the refrigerator oil is performed, for example, for about 1–3 minutes at every 2 hours and in that case, the recovery operation is performed not only for the operating room units but also non-operating or resting room units.

Figure 4:
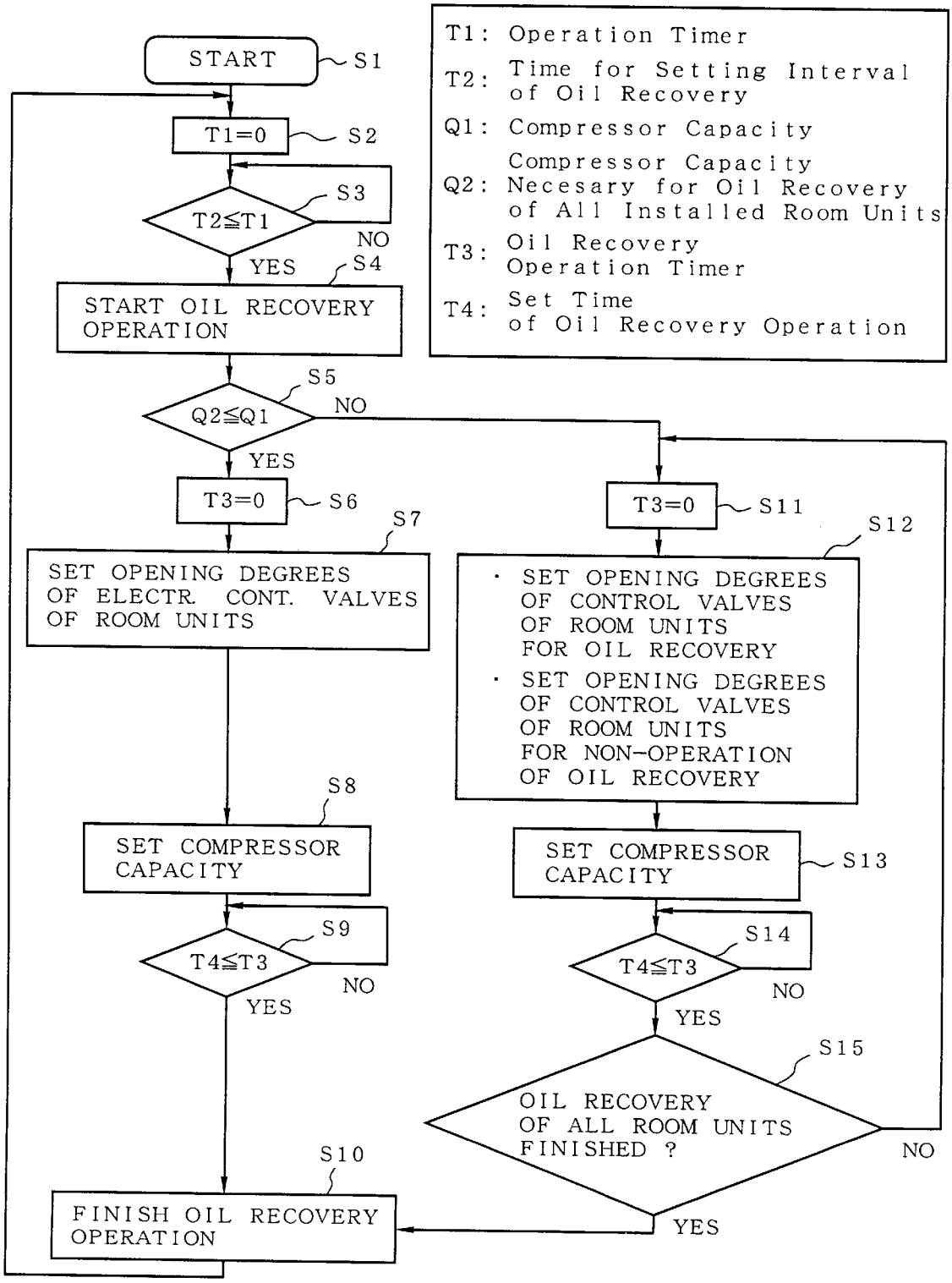
FIG. 4 is a flow diagram of an oil recovery operation according to the present invention.

FIG. 4 is a flow diagram showing the operation of the embodiment of the present invention where the control is started at step S1. At step S2, a value of an operation timer T1 is set to 0 (timer T1 is reset) and the operation timer T1 starts counting. At step S3, whether the count value of the timer T1 reaches T2 (T2 is a time period setting a recovery interval of the refrigerator oil and is arbitrarily set in consideration of the lengths and the diameters of the refrigerant pipes constituting the refrigerating cycle, for example 2 hours), is determined ($T2 \leqq T1$).

When the condition of step S3 is satisfied, the oil recovery operation is started at step S4 and the following steps are executed. First, at step S5, determination of $Q2 \leqq Q1$ (compressor capacity necessary for simultaneously returning oil for all installed room units≦maximum capacity of compressor), that is whether the refrigerator oil can simultaneously be returned from all of the room units, is determined.

When the condition of step S5 is satisfied, the operation proceeds to step S6 where a value of an oil recovery operation timer T3 is set to 0 (oil recovery operation timer T3 is reset) and counting is started. At the same time, electronic control valves of the room units are fully opened at step S7 to make the opening degree thereof maximum, and the operation proceeds to step S8 where the operation capacity of the compressor is increased to an operation capacity capable of returning the refrigerator oil.

At step S9, whether the operation of refrigerator oil recovery has been performed for a refrigerator oil recovery operation time T4 (for example, about 3 minutes) is determined. That is, the recovery operation of the refrigerator oil is continued until $T4 \leqq T3$ is satisfied. When step S9 is satisfied, the recovery operation of the refrigerator oil is finished at step S10, the operation proceeds to a normal operation and thereafter returns to step S2 where the operation is ready for a successive recovery operation of the refrigerator oil.

Further, when $Q2 \leqq Q1$ is not satisfied at step S5, the operation proceeds to step S11 for carrying out the recovery operation of the refrigerator oil at plural times as shown by Table 3. At step S11, similar to step S6, T3=0 is set. Next, at step S12, the operation sets the opening degrees of flow rate control valves of room units for starting the recovery of the refrigerator oil and sets the opening degrees of flow rate control valves of room units for not returning the refrigerator oil to about half values thereof in returning the refrigerator oil.

However, the opening degrees of the flow rate control valves of the room units for not returning the refrigerator oil are not limited to those but naturally may arbitrarily be set in compliance with the operation capacity of the compressor or may be brought into a closed state.

Next, at step S13, the operation capacity of the compressor is set similar to step S8 and at step S14, similar to step S9, the time for continuing the recovery operation of the refrigerator oil is controlled.

Next, when the condition of step S14 is satisfied, at step S15, whether all of the recovery operation of the refrigerator oil that is set at plural times has been finished is determined. When the recovery operation has not been finished for all the times, the operation returns to steps S11 through S14 again, and the recovery operation of the refrigerator oil in unfinished patterns is started based on Table 3. When the condition of step S15 is satisfied, the operation proceeds to step S10 where processings of finishing the recovery operation of the refrigerator oil are performed.

According to the flow diagram of FIG. 4, the recovery operation of the refrigerator oil is carried out at every predetermined time period T2 (2 hours) for setting the interval of the recovery operation of the refrigerator oil, but, if desired, the oil level sensor 102 may be installed to the compressor and the recovery operation of the refrigerator oil may be performed when a detected value of the oil level sensor is a predetermined value or less. In this case, another step for carrying out determination of "oil level≦set value" may be provided in place of the operation at steps S1 and S2.

Although an explanation has been given of specific embodiments, the present invention is not limited to such specific embodiments. For example, although in the above embodiments the flow rate of the refrigerant capable of firmly performing refrigerator oil recovery is set to 10 m/s, the value can pertinently be changed in accordance with the refrigerator oil, the refrigerant, the specification of the pipes and the like and is not limited to such value. Further, although in the embodiment, four of the above room units are divided into two room unit groups each having two of the room units according to operation patterns 1 and 2, refrigerator oil recovery may be performed for each of the room units and a total number of the room units, combinations of the room unit groups and the like may pertinently be set. Further, the compressor installed to the outdoor unit may be of a discharge amount variable type or may be of a constant speed type. Further, the present invention is not limited to the multi-unit type air conditioner but is applicable to all air conditioners including an air conditioner having one outdoor unit and one room unit.

As has been explained, according to the present invention, there is provided an air conditioner having an outdoor unit and a plurality of room units supplied with a refrigerant from the outdoor unit in which in a recovery operation of a refrigerator oil, the plurality of room units are divided into a plurality of room unit groups, and refrigerant supply controlling means is provided for controlling the supply of the refrigerant for the respective room unit groups. Therefore, a sufficient amount of the refrigerant can be supplied to each of the room unit groups, and recovery of the refrigerant oil in the refrigerant pipes can be performed in a short period of time and with certainty.

What is claimed is:

1. A method of returning a refrigerator oil of an air conditioner, said air conditioner having a refrigerating cycle for circulating a mixture of a refrigerant and a refrigerator oil by using a compressor, a heat side heat exchanger, pressure reducing devices, a plurality of user side heat exchangers and devices constituting the refrigerating cycle by separating the devices into a heat side unit and a plurality of user side units, said method comprising conducting a recovery operation for returning said refrigerator oil from said user side units by:

dividing said plurality of user side units into a plurality of user side unit groups; and carrying out a recovery operation of said refrigerant for each of said user side unit groups of said user side units, to thereby return said refrigerator oil from said user side heat exchangers every time said air conditioner reaches a state of a predetermined condition.

2. The method of returning a refrigerator oil of an air conditioner according to claim 1, wherein during operation to return said refrigerator oil a flow rate of said mixture of refrigerant and refrigerator oil flowing in the plurality of user side units is maintained at a predetermined value or more.

3. The method of returning a refrigerator oil of an air conditioner according to claim 2, wherein said refrigerant is an HFC refrigerant.

4. The method of returning a refrigerator oil of an air conditioner according to claim 3, wherein the number of said user side units included in respective said groups is equivalent to a number of said units for maintaining the flow rate of said mixture at a predetermined value or more during operation to return said refrigerator oil.

* * * * *